US009169596B2

(12) United States Patent
Pykäläinen et al.

(10) Patent No.: US 9,169,596 B2
(45) Date of Patent: Oct. 27, 2015

(54) PAPER PRODUCT AND PROCESS FOR MAKING SAME

(75) Inventors: Nina Pykäläinen, Lappeenranta (FI); Sami Turunen, Lappeenranta (FI); Tarja Sinkko, Lappeenranta (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 13/376,433

(22) PCT Filed: Jun. 18, 2010

(86) PCT No.: PCT/FI2010/050520

§ 371 (c)(1),
(2), (4) Date: Dec. 6, 2011

(87) PCT Pub. No.: WO2010/146244

PCT Pub. Date: Dec. 23, 2010

(65) Prior Publication Data

US 2012/0085506 A1 Apr. 12, 2012

(30) Foreign Application Priority Data

Jun. 18, 2009 (FI) ..... 20095692

(51) Int. Cl.
*D21H 21/22* (2006.01)
*D21H 21/52* (2006.01)
(Continued)

(52) U.S. Cl.
CPC ..... *D21B 1/04* (2013.01); *D21H 11/12* (2013.01); *D21H 15/02* (2013.01); *D21H 17/02* (2013.01); *D21H 21/22* (2013.01); *D21H 21/52* (2013.01)

(58) Field of Classification Search
USPC ..... 162/141, 142, 148, 149, 157.7, 158, 162/163, 13, 21–28, 91, 94–99, 176, 162/183–185; 106/162.1–162.9, 163.01, 106/164.01, 165.01, 166.01, 400
See application file for complete search history.

(56) References Cited

U.S. PATENT DOCUMENTS 5,083,897 A * 1/1992 Hand et al. ..... 414/746.4
5,227,024 A 7/1993 Gomez
(Continued)

FOREIGN PATENT DOCUMENTS

EP 0 645 491 A1 3/1995
EP 0644293 3/1995
(Continued)

OTHER PUBLICATIONS

J. Peel, Paper Science & Paper Manufacture 1999, pp. 18-19.*
(Continued)

*Primary Examiner* — Dennis Cordray
(74) *Attorney, Agent, or Firm* — Merchant & Gould P.C.

(57) ABSTRACT

The invention relates to a paper product formed from fiber-based pulp to which a material component of plant origin is added. According to the invention, the material component of plant origin is a material which is formed from small particles and which is formed from a source material of plant origin selected at least mainly from the group of bark free wood, stem parts of plants and their combinations and their derivatives, and the paper product contains 4 to 50 vol-% of the material component of plat origin, substantially to increase the printing area in the paper product relative to the bulk of the paper. In addition, the invention relates to a process for manufacturing a paper product.

6 Claims, 2 Drawing Sheets

(51) Int. Cl.

| | |
|---|---|
| ***D21H 11/12*** | (2006.01) |
| ***D21H 17/02*** | (2006.01) |
| ***D21H 15/02*** | (2006.01) |
| ***D21B 1/04*** | (2006.01) |

(56) References Cited

U.S. PATENT DOCUMENTS

| | | | | |
|---|---|---|---|---|
| 6,592,712 | B2 * | 7/2003 | Koukoulas et al. | 162/9 |
| 2001/0000063 | A1 * | 3/2001 | Silenius et al. | 162/181.1 |
| 2002/0084050 | A1 * | 7/2002 | Silenius et al. | 162/181.1 |
| 2004/0168783 | A1 | 9/2004 | Munchow | |
| 2007/0101904 | A1 | 5/2007 | Peltonen et al. | |
| 2007/0131370 | A1 | 6/2007 | Silenius et al. | |

FOREIGN PATENT DOCUMENTS

| | | | |
|---|---|---|---|
| EP | 1 302 251 | A2 | 4/2003 |
| KR | 10-0898383 | B1 | 5/2009 |
| WO | WO 2007/003699 | A1 | 1/2007 |
| WO | WO 2009/080894 | A1 | 7/2009 |

OTHER PUBLICATIONS

Smook, Gary A., Handbook for Pulp and Paper Technologists, 2nd ed, Angus Wilde Publications, 1992, p. 220.*

"Filler Minerals Reference. A Guide to Filler Properties and Uses" (R.T. Vanderbilt Company, Inc., 2009, 6 pages, [online], retrieved from the Internet [retrieved Oct. 17, 2011], <URL: http://www.rtvanderbilt.com/VR703forweb.pdf.*

"Fibers, Regernerated Cellulose", Kirk-Othmer Encyclopedia of Chemical Technology, John Wiley & Sons, [Published Online], 2003, vol. 11, pp. 246-285. http://onlinelibrary.wiley.com/doi/10.1002/0471238961.180507052315150 4.a01.pub2/pdf.*

International Search Report for corresponding International Patent Application No. PCT/FI2010/050520 mailed Nov. 17, 2010.

Finnish Search Report for corresponding Finnish Patent Application No. 20095692 mailed May 5, 2010.

Heikkurinen, A. et al.: "Chapter 15: The Character and Properties of Mechanical Pulps" In Book 5: Mechanical Pulping ed., Sundholm, J., in Book Series: Papermaking Science and Technology, Gummerus Printing, Finland, 1999, pp. 395-413.

Retulainen, E. et al. "Papermaking quality of fines from different pulps—the effect of size, shape and chemical composition", Appita, vil. 55, No. 6, Nov. 2002, pp. 457-460.

Luukko, K. et al. "Mechanical pulp fines: Effect of particle size and shape", Tappi Journal, vol. 82, No. 2, 1998, pp. 95-101.

Supplementary European Search Report for corresponding European Patent Application No. 10789071 mailed Feb. 11, 2014.

* cited by examiner

PAPER PRODUCT AND PROCESS FOR MAKING SAME

This application is a National Stage Application of PCT/FI2010/050520, filed 18 Jun. 2010, which claims benefit of Serial No. 20095692, filed 18 Jun. 2009 in Finland and which applications are incorporated herein by reference. To the extent appropriate, a claim of priority is made to each of the above disclosed applications.

FIELD OF THE INVENTION

The invention relates to a paper product and to a process for making a paper product, where the paper product is formed from fiber-based pulp to which a material component of plant origin is added.

BACKGROUND OF THE INVENTION

Known from the prior art are different paper products and processes for manufacturing them from fiber-based pulp. The addition of different filler, pigment and additional components to fiber-based pulp is known. Typically, different mineral-based pigments and fillers are used. Known from the prior art is also the addition of pigments and fillers of organic origin to pulp to manufacture paper. Known from the prior art is the formation of organic pigments from oil-based raw stock and starch-based materials as well as from pure cellulose by chemical treatment steps.

When the mineral fillers and coating pigments are replaced by materials of organic origin either partially or completely, the environmental load can be reduced, e.g. recyclability of paper can be improved.

Known from publication U.S. Pat. No. 5,227,024 is the use of a vegetable filler in connection with the manufacture of a sheet material. At least 80 w-% of the particles in the vegetable filler are particles having a size of more than 10 μm.

OBJECTIVE OF THE INVENTION

An objective of the invention is to disclose a new type of a paper product and a process for making same by using a new type of a source material composition. In addition, an objective of the invention is to provide a paper product with a larger printing area relative to the bulk of the paper.

SUMMARY OF THE INVENTION

The paper product and the process according to the invention are characterized by what has been presented in the claims.

The invention is based on a paper product which is preferably suitable to be used as printing paper and/or as a printed product. The paper product is formed from fiber-based pulp to which a material component of plant origin is added. According to the invention, the material component of plant origin is a material which is formed from small particles and which is formed from a source material of plant origin selected at least mainly from the group of bark free wood, stem parts of plants and their combinations and their derivatives, and the paper product contains 4 to 50 vol-% of the material component of plant origin substantially to increase the printing area in the paper product relative to the bulk of the paper product.

The material component of plant origin is preferably a low-density particle material. The bulk density of the material component of plant origin is influenced by the particle size, moisture and source of raw stock of the material, but typically it is at a level of 0.15 to 0.25 g/cm$^3$. In one embodiment, the solid density of the material component of plant origin is between 0.3 and 1.8 g/cm$^3$ and in one embodiment 0.7 to 1.5 g/cm$^3$.

By a paper product is meant in this connection any fiber-based paper or fiber product, paper or the equivalent. The paper product may be formed from any fiber-based pulp, such as chemical pulp, mechanical pulp, chemimechanical pulp, recycled pulp, fiber pulp and/or their mixtures or the equivalent. The paper product may contain suitable fillers and additives, pigments and different surface treatment and coating agents. The paper product may be in the form of a web or a sheet or in other form suitable for the purpose of use. In one embodiment, the paper product may be selected from the group of SC papers, newsprints, WFU, coated papers, such as LWC and WFC, and soft tissues.

By a material component of plant origin is meant in this connection any particle material formed from a source material of plant origin. The material component of plant origin may be a pigment, filler, additive or such to be added to fiber-based pulp, and/or it may replace at least partially some of the above-mentioned.

In one embodiment of the invention, the bark free wood is selected from the group of trunk parts of a tree, branches of a tree, wood pieces, dust, sawdust, chips, wet wood, waste wood, pulp, wood pulp, mechanical pulp, their derivatives, their mixtures or the equivalent, excluding the bark part of a tree. The wood may originate in any wood species, e.g. a softwood or a hardwood species, or in a mixture of different wood species.

In one embodiment of the invention, the material component of plant origin is formed, at least partially or mainly, from a fiber-based plant source material selected from the group of grasses, herbs, cereals or the equivalent, straw, plant pieces, culm parts of plants, their derivatives, their mixtures or such. Preferably used are the stem parts of the plants, i.e. the cornless, berryless and fruitless parts of the plants, selected from the above-mentioned source materials.

In one embodiment, the material component of plant origin is formed from a mixture of source materials of plant origin containing different source materials of plant origin, e.g. bark free wood-based and/or plant-based source materials mainly formed from stem parts of the plants. Different materials of plant origin, waste from the forest industry, recycling materials, such as recycled paper and recycled fibers, and/or materials previously considered as reject products can be used as a source material of plant origin.

In one preferred embodiment, the material component of plant origin is formed from chemically untreated source material of plant origin by mechanical processing. In one embodiment, the source material is treated chemically before mechanical processing. In one embodiment, the source material of plant origin is treated only mechanically.

In one embodiment of the invention, the material component of plant origin is formed by grinding a source material of plant origin in one or more steps.

By grinding is meant in this connection any grinding, pulverizing, crushing or breaking up of a material, e.g. by braying or rubbing, to a desired particle size. The operation of grinding devices, e.g. mills, is typically based on focusing pressure, cutting, abrasion, compaction and/or on an effect of a collision provided by a blast or on an equivalent operating principle. Most of the grinding devices operate as a combination of many operating principles.

In one embodiment, the grinding of a source material of plant origin is made by a grinding method selected from the group of grinding based on crushing, grinding based on abrasion, grinding based on cutting, grinding based on explosion, wet grinding, dry grinding, pressurized grinding and their combinations. In one embodiment, the grinder used is selected from the known grinding devices, such as an impact mill, jet mill, sand mill, bead mill, ball mill, vibration mill, screw mill and their combinations. The grinding can be made in one or more grinding steps by one or more grinding methods.

In one embodiment, a material component of plant origin is used in the paper product to provide in the paper product lightness and reduced density as well as improved strength and rigidity without altering the optical properties, as compared with the current paper products, especially printed products, containing a mineral pigment and/or filler, while increasing the printing area relative to the bulk of the paper in the paper product according to the invention.

In one embodiment, a material component of plant origin is used in the paper product to provide in the paper product lightness and reduced density, as well as substantially invariable properties, such as the strength, rigidity and optical properties, as compared with the current paper products, especially printed products, containing a mineral pigment and/or filler, while increasing the printing area relative to the bulk of the paper in the paper product according to the invention.

In one embodiment, most of the particles in a material component of plant origin are particles of less than 100 μm. In one embodiment, 100 vol-% of the particles in a material component of plant origin are particles of less than 100 μm. In one embodiment of the invention, at least 95 vol-% of the particles in a material component of plant origin are particles of less than 100 μm. In one embodiment, at least 95 vol-% of the particles in a material component of plant origin are particles of less than 75 μm. In one embodiment, at least 95 vol-% of the particles in a material component of plant origin are particles of less than 50 μm. In one embodiment, at least 30 vol-% of the particles in a material component of plant origin are particles of less than 10 μm. In one embodiment, at least 50 vol-% of the particles in a material component of plant origin are particles of less than 10 μm. In one embodiment, at least 60 vol-% of the particles in a material component of plant origin are particles of less than 10 μm.

In one embodiment of the invention, the particle size d50 (vol-%) of a material component of plant origin is between 5 and 20 μm. In one embodiment, the average particle size of the particles in a material component of plant origin is between 5 and 10 μm. In one embodiment, the average particle size of the particles in a material component of plant origin is between 10 and 15 μm. In one embodiment, the d50 (vol-%) of a hardwood-based material component is between 5 and 10 μm as measured by a measuring device based on laser diffraction. In one embodiment, the d50 (vol-%) of a softwood-based material component is between 7 and 14 μm as measured by a measuring device based on laser diffraction. In one embodiment, the d50 (population %) of a hardwood-based material component is between 0.9 and 1 μm.

In one embodiment of the invention, the paper product contains 4 to 40 vol-% of a material component of plant origin. In one embodiment, the paper product contains more than 5 vol-% of a material component of plant origin. In one embodiment, the paper product contains less than 30 vol-% of a material component of plant origin. In one embodiment, the paper product contains 5 to 25 vol-% of a material component of plant origin. In one embodiment, the paper product contains 5 to 22 vol-% of a material component of plant origin.

In addition, the invention is based on a process for manufacturing a paper product, where the paper product is formed from fiber-based pulp and a material component of plant origin is added to the fiber-based pulp. According to the invention, a material which is formed from small particles and which is formed from a source material of plant origin selected at least mainly from the group of bark free wood, stem parts of plants and their combinations and their derivatives is used as the material component of plant origin, and 4 to 50 vol-% of the material component of plant origin is provided in the paper product substantially to increase the printing area in the paper product relative to the bulk of the paper.

The material component of plant origin can be used in papermaking and in the paper product as a pigment, filler, surface treatment agent and/or coating agent of the paper and/or as a part of them.

In one embodiment, the mineral-based pigment and/or filler in the paper product, e.g. printing paper, is replaced at least partially or completely by a material component of plant origin. In one embodiment, the paper product according to the invention contains not more than 5 w-%, preferably less than 3 w-%, more preferably less than 1 w-%, of a mineral-based material component.

In one preferred embodiment, the paper product according to the invention is suitable to be used as printing paper and/or a printed product, e.g. in gravure printing, offset printing and inkjet printing methods or in any other suitable printing method.

By the invention, considerable advantages are achieved as compared with the known paper products.

By the process according to the invention, a paper product having a lower grammage than in the previously known paper and printed products is provided. In addition, thanks to the invention, a paper product which has an increased printing area relative to the bulk of the paper is provided. Cost savings are achieved by the paper product according to the invention, e.g. in transportation costs, thanks to a lower grammage. The transportation costs of the material component of plant origin according to the invention are also lower than transportation costs of the conventional filler and pigment materials.

Additionally, an advantage of the paper product according to the invention is its friendliness to the environment and better recyclability. The paper product according to the invention has a better fuel value than before, and the amount of ash produced in burning is substantially smaller due to small amount of mineral-based components. Thus, the paper product according to the invention has a better carbon footprint as compared with the previously known products.

By the invention, an industrially applicable simple and inexpensive manner of manufacturing a paper product is achieved. The process according to the invention can be easily and simply carried out as a production process.

DETAILED DESCRIPTION OF THE INVENTION

The invention will be described in more detail by the following examples with reference to the accompanying FIGS. 1 and 2.

Figure 1:
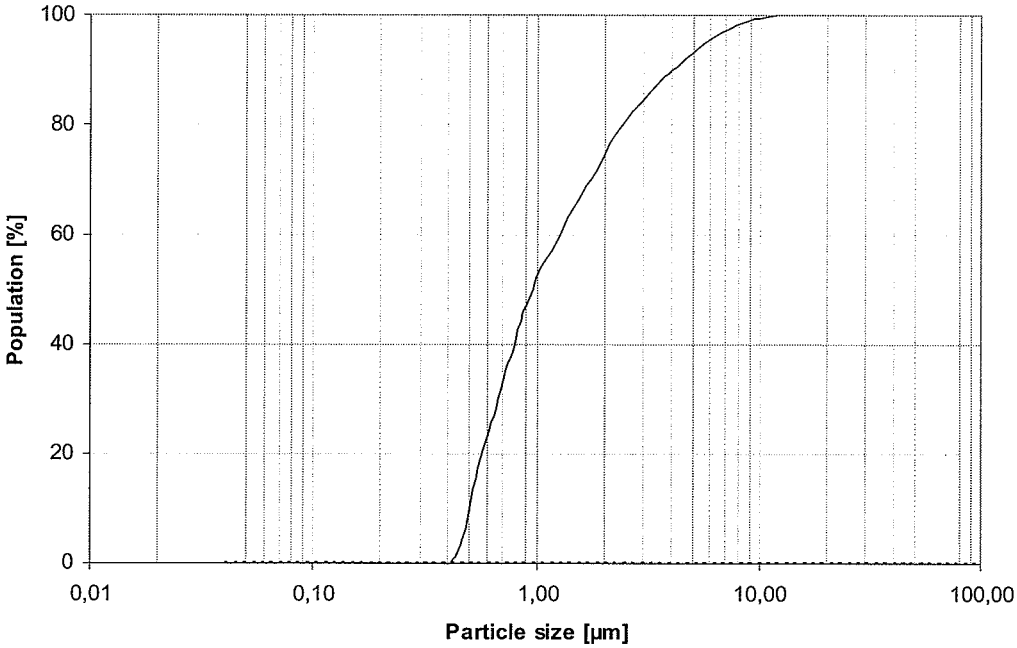
FIG. 1 presents the cumulative particle size distribution of one material component of plant origin according to the invention representing the population relative to particle size.

FIG. 1 presents the cumulative particle size distribution of one material component of plant origin according to the invention representing the population relative to particle size.

Figure 2:
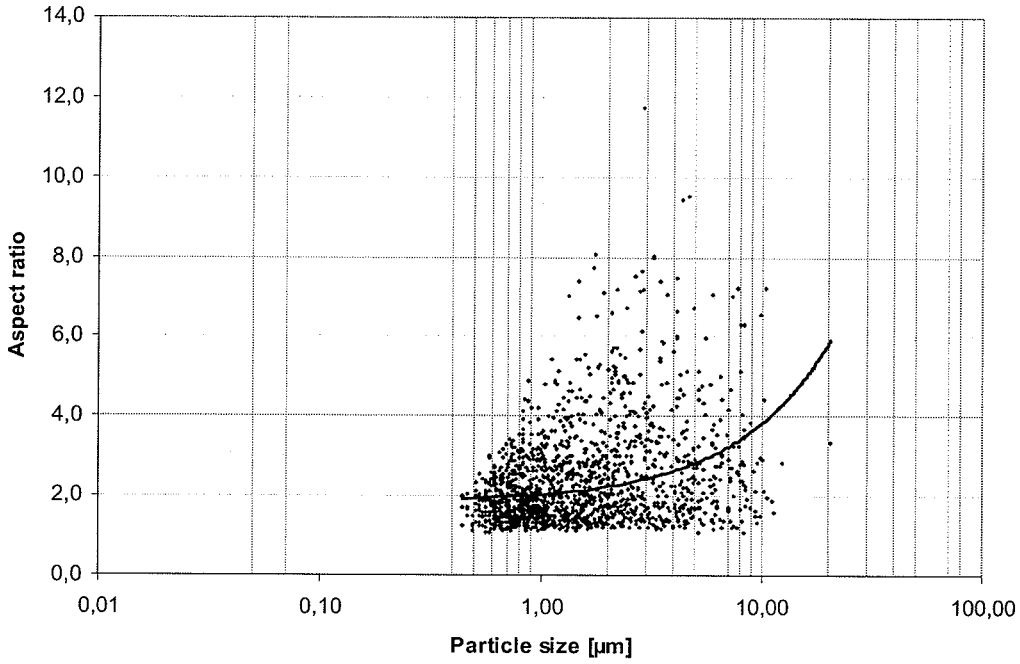
FIG. 2 presents the form factor graph of one material component of plant origin according to the invention representing the aspect ratio of the particles relative to particle size.

FIG. 2 presents the form factor graph of one material component of plant origin according to the invention representing the aspect ratio of the particles relative to particle size.

EXAMPLE 1

In this example, the manufacture of SC paper of approximately 60 gsm from fiber-based pulp with the particle material of plant origin according to the invention added thereto was examined on a laboratory scale. Conventional SC paper of approximately 60 gsm in which PCC (approximately 30 w-%) was used as a filler was used as reference paper. The paper according to the invention to be examined and the reference paper contained the added filler in the same volumetric ratio of approximately 11 vol-%.

The particle material of plant origin was formed from bark free hardwood dust by grinding in two steps so that the particle size distribution of the particle material was obtained as: d80 of less than 10 μm. The d50 (vol-%) of the hardwood-based particle material was 5.7 μm as measured by a measuring device based on laser diffraction. The d50 (population %) of the hardwood-based particle material was 0.96 μm as scanned by a SEM and analyzed by image processing software. The cumulative particle size distribution, i.e. the population % relative to particle size, is presented in FIG. 1.

The particle size distribution of the hardwood-based particle material was as follows:

d10(vol-%)=2.3 μm
d30(vol-%)=4.0 μm
d50(vol-%)=5.7 μm
d60(vol-%)=6.8 μm
d70(vol-%)=8.1 μm
d80(vol-%)=10.1 μm
d90(vol-%)=13.9 μm The specific perimeter of the hardwood-based particle material (the perimeter over area) was 1.74 1/μm.

The paper of 60 gsm according to the invention contained approximately 16.6 w-% of the hardwood-based particle material.

Different properties were determined from the obtained paper and from the reference paper. The results are presented in Table 1.

TABLE 1

| Filler and amount | | | Mineral pigment mixture, 11 vol-% | Hardwood-based particle material, 11 vol-% |
|---|---|---|---|---|
| Grammage | g/m$^2$ | ISO 5270: 1998(E) | 60.9 | 59.4 |
| Bulking thickness | μm | ISO 5270: 1998(E) | 66 | 83.1 |
| Solid density | kg/m3 | ISO 5270: 1998(E) | 919 | 715 |
| Bulk | cm3/g | ISO 534: 2005(E) | 1.09 | 1.4 |
| Tensile index | Nm/g | ISO 5270, 1924-2 | 25.3 | 39.5 |
| Elongation at break | % | ISO 5270, 1924-2 | 2.7 | 2.9 |
| Breaking energy index | J/kg | ISO 5270, 1924-2 | 441 | 743 |
| Extension stiffness index | MNm/kg | — | 2.1 | 3.0 |

TABLE 1-continued

| Filler and amount | | | Mineral pigment mixture, 11 vol-% | Hardwood-based particle material, 11 vol-% |
|---|---|---|---|---|
| Breaking length | m | — | 2581 | 4022 |
| Tear index | mNm2/g | ISO 5270: 1998(E) | 4.7 | 6.1 |
| Bonding power | J/m2 | — | 141 | 185 |
| Bending resistance | mN | ISO 2493: 1992(E) | 16 | 29.2 |
| Oil absorption | g/m2 | SCAN-P 37: 77 | 9.4 | 12.6 |
| Color absorption | % | | 80.8 | 84.8 |

On the basis of the tests, it could be observed that, by the process according to the invention, a paper product of a very good quality which had improved bond strength properties, tensile strength and tear resistance properties was provided. In addition, the opacity, scattering of light and other properties were not altered substantially relative to the reference paper. The obtained paper according to the invention had lower density.

In addition, it was discovered in the tests according to Example 1 that in using softwood dust as a source material for a particle material of plant origin, similar results were achieved as in using hardwood dust.

EXAMPLE 2

In this example, the size and form factors of the particles in a particle material of plant origin formed from a hardwood-based source material were examined. The form factors of 2072 particles were analyzed in the test. The particles were scanned by a SEM and analyzed by image processing software. The results are presented in Tables 2 and 3 (the arithmetic particle size distribution) and in FIG. 2. FIG. 2 presents the form factor graph for the particle material of plant origin representing the aspect ratio of the particles relative to particle size.

TABLE 2

| Particle size | |
|---|---|
| % <0.1 μm | 0.0 |
| % <0.3 μm | 0.0 |
| % <0.5 μm | 9.7 |
| % <1.0 μm | 51.8 |
| % <2.0 μm | 74.7 |
| % <5.0 μm | 93.6 |
| Average (μm) | 1.71 |
| Median (μm) | 0.96 |
| Average area (μm$^2$) | 4.89 |
| Average perimeter (μm) | 8.52 |
| Average length (μm) | 3.25 |
| Average width (μm) | 1.40 |

TABLE 3

| Particle size distribution | |
|---|---|
| d20 | 0.56 |
| d30 | 0.66 |

TABLE 3-continued

| | |
|---|---|
| d50 | 0.96 |
| d70 | 1.70 |
| Steepness of distribution | |
| d20/d50 | 59 |
| d30/d70 | 39 |

In the tests, the obtained average aspect ratio of the particle form was 2.18 and the average roundness was 1.93.

In the tests, it was observed that preferably the particle in a particle material of plant origin has a small form factor.

EXAMPLE 3

In this example, the manufacture of SC paper of approximately 53 gsm from fiber-based pulp with the particle material of plant origin according to the invention added thereto was examined by pilot tests. Conventional SC paper of approximately 53 gsm in which PCC was used as a filler was used as reference paper. The paper according to the invention to be examined and the reference paper contained the added filler in the same volumetric ratio of approximately 12 vol-%.

The particle material of plant origin was formed from bark free softwood dust by grinding with a mill on a production scale. The particle size distribution of the bark free softwood-based particle material is presented in Table 4.

TABLE 4

| Particle size | μm |
|---|---|
| d10 (vol-%) | 4.0 |
| d20 (vol-%) | 6.7 |
| d30 (vol-%) | 9.2 |
| d50 (vol-%) | 14.4 |
| d70 (vol-%) | 21.5 |
| d90 (vol-%) | 36.1 |
| Average | 17.8 |

The test run was performed by a paper machine pilot and the paper samples were calendered. The results were interpolated so as to obtain the same gloss levels for the reference paper and the paper according to the invention to be examined.

Different properties were determined from the paper according to the invention and from the reference paper. The results are presented in Table 5.

TABLE 5

| Filler and amount | | | Mineral pigment mixture, 12 vol-% | Softwood-based particle material, 12 vol-% |
|---|---|---|---|---|
| Grammage | g/m2 | ISO 536: 1995(E) | 52.5 | 53.6 |
| Ash 525° C. | % | ISO 1762: 2001 | 32.0 | 1 |
| Thickness AL | μm | ISO 534: 2005 | 59.0 | 67.0 |
| Apparent density of sheet AL | kg/m3 | ISO 534: 2005 | 755 | 800 |
| Bulk AL | cm3/g | ISO 534: 2005 | 1.125 | 1.240 |
| Tensile index md AL | Nm/g | ISO 1924-3: 2005 | 47.0 | 65.5 |
| Tensile index cd AL | Nm/g | ISO 1924-3: 2005 | 15.9 | 26.0 |
| Elongation at break md AL | % | ISO 1924-3: 2005 | 1.4 | 1.6 |

TABLE 5-continued

| Filler and amount | | | Mineral pigment mixture, 12 vol-% | Softwood-based particle material, 12 vol-% |
|---|---|---|---|---|
| Elongation at break cd AL | % | ISO 1924-3: 2005 | 2.3 | 2.5 |
| Tear index md AL | mNm2/g | ISO 1974: 1990 | 4.15 | 4.45 |
| Tear index cd AL | mNm2/g | ISO 1974: 1990 | 6.41 | 6.50 |
| Bending resistance md | mN | ISO 2493: 1992 | 20 | 31 |
| Bending resistance cd | mN | ISO 2493: 1992 | 8 | 13 |
| Internal bond strength | J/m2 | T569 pm-00 | 268 | 322 |
| Gloss ts | % | ISO 8254-1: 2009 | 35 | 35 |
| Oil absorption Unger 5 s ts | g/m2 | SCAN-P 37: 77 | 10.3 | 8.5 |
| Color absorption M.C. Blue 2 min ts | % | | 27.0 | 28 |

On the basis of the tests, it could be observed that, by the process according to the invention, a paper product of a very good quality which had improved bond strength properties and tensile strength properties was provided. The obtained paper according to the invention had improved bulk properties. In the pilot tests, similar results were obtained as in the earlier tests on a laboratory scale.

On the basis of all tests, it was observed that a paper product of a good quality could be formed from fiber pulp and a particle material of plant origin. An easily industrially applicable manner of manufacturing a new environmentally friendly paper product was discovered.

The paper product and the process for making same according to the invention are suitable as different embodiments for use in the manufacture of most different end products. The invention can be applied for use in the manufacture of different paper products in which it is desirable to utilize a particle material of plant origin as one raw material, e.g. partially or completely to replace pigments and/or fillers of mineral origin, and in which it is desirable to improve the bulk of the paper product.

The invention is not limited merely to the example referred to above; instead, many variations are possible within the scope of the inventive idea defined by the claims.

The invention claimed is:

1. A paper product which is formed from fiber-based pulp to which a material component of plant origin is added, wherein the material component of plant origin is a material which is formed from a source material of plant origin selected at least mainly bark free wood, and which is formed from the source material of plant origin by grinding, and at least 30 vol-% of the small particles in the material component of plant origin are particles of less than 10 μm, a particle size d50 (vol-%) in the material component of plant origin is 5 to 20 μm, an average particle size of 5-17.8 μm, and the paper product contains 5 to 25 vol-% of the material component of plant origin to increase a printing area in the paper product relative to a bulk of the paper.

2. The paper product according to claim 1, wherein at least 95 vol-% of the particles in a material component of plant origin are particles of less than 100 μm.

3. The paper product according to claim 1, wherein the bark free wood is selected from the group of trunk parts of a tree, branches of a tree, wood pieces, dust, sawdust, chips, wet wood, waste wood, pulp, wood pulp, mechanical pulp or combinations thereof.

4. A process for manufacturing a paper product, the process comprising adding a material component of plant origin to a fiber-based pulp, wherein the material component of plant origin is formed from a source material of plant origin selected at least mainly from bark free wood, and which is formed from the source material of plant origin by grinding, and at least 30 vol-% of the small particles in the material component of plant origin are small particles of less than 10 μm, a particle size d50 (vol-%) in the material component of plant origin is 5 to 20 μm, an average particle size of 5-17.8 μm, and 5 to 25 vol-% of the material component of plant origin is provided in the paper product to increase a printing area in the paper product relative to a bulk of the paper.

5. The process according to claim 4, wherein the bark free wood is selected from the group of trunk parts of a tree, branches of a tree, wood pieces, dust, sawdust, chips, wet wood, waste wood, pulp, wood pulp, mechanical pulp and their combinations.

6. The process according to claim 4, wherein the material component of plant origin is formed from small particles so that at least 95 vol-% of the small particles are small particles of less than 100 μm.

* * * * *

UNITED STATES PATENT AND TRADEMARK OFFICE

CERTIFICATE OF CORRECTION

PATENT NO. : 9,169,596 B2
APPLICATION NO. : 13/376433
DATED : October 27, 2015
INVENTOR(S) : Nina Pykäläinen, Sami Turunen and Tarja Sinkko It is certified that error appears in the above-identified patent and that said Letters Patent is hereby corrected as shown below:

In the Claims
Col. 8, line 56: "mainly bark free" should read --mainly from bark free--

Signed and Sealed this
Twenty-eighth Day of June, 2016

Michelle K. Lee

Michelle K. Lee
*Director of the United States Patent and Trademark Office*